United States Patent [19]

Mancini et al.

[11] Patent Number: 4,858,851

[45] Date of Patent: Aug. 22, 1989

[54] FOLDING WING STRUCTURE FOR MISSILE

[75] Inventors: Steven A. Mancini, Claremont; Joseph D. Kutschka, Alta Loma, both of Calif.

[73] Assignee: General Dynamics Pomona Division, Pomona, Calif.

[21] Appl. No.: 203,200

[22] Filed: Jun. 7, 1988

[51] Int. Cl.[4] ..... F42B 13/32

[52] U.S. Cl. ..... 244/327; 244/3.28

[58] Field of Search ..... 244/3.27, 3.28, 3.29, 244/49

[56] References Cited

U.S. PATENT DOCUMENTS

| | | | |
|---|---|---|---|
| 2,959,143 | 11/1960 | Endrezze | 114/20 |
| 3,194,514 | 7/1965 | Rogallo | 244/49 |
| 3,197,158 | 7/1965 | Rogallo | 244/49 |
| 3,633,846 | 1/1972 | Biggs, Jr. | 244/3.27 |
| 3,788,578 | 1/1974 | Sweeney et al. | 244/3.28 |
| 3,796,399 | 3/1974 | Wechsler | 244/153 |
| 3,826,448 | 7/1974 | Burk, Jr. | 244/91 |
| 3,990,656 | 11/1976 | Minnich | 244/3.27 |
| 4,106,727 | 8/1978 | Ortell | 244/49 |
| 4,351,499 | 9/1982 | Maudal et al. | 244/3.27 |
| 4,411,398 | 10/1983 | Wedertz et al. | 244/3.28 |
| 4,568,044 | 2/1986 | DiTommaso et al. | 244/49 |
| 4,586,680 | 5/1986 | DiTommaso et al. | 244/3.27 |
| 4,586,681 | 5/1986 | Wedertz et al. | 244/49 |
| 4,664,338 | 5/1987 | Steuer et al. | 244/328 |

*Primary Examiner*—Deborah L. Kyle
*Assistant Examiner*—Michael J. Carone
*Attorney, Agent, or Firm*—Neil F. Martin; Leo R. Carroll

[57] ABSTRACT

A folding wing structure for a missile or other airframe comprises a supporting strut assembly including a leading strut and a trailing strut pivotally secured together at their common ends and pivotally mounted at spaced locations relative to the airframe at their opposite ends, the struts being moveable between a collapsed, storage position in which they are substantially colinear and an expanded, erect position in which they project radially out from the missile. A biassing device urges the struts into the erect position. A double walled, pocket-like wing member of flexible fabric material encloses the strut assembly and conforms substantially to the extended configuration of the struts, and a series of spaced, parallel reinforcing ribs extend chordwise across each wall of the wing member in its erect position between the leading and trailing struts.

8 Claims, 2 Drawing Sheets

FOLDING WING STRUCTURE FOR MISSILE

BACKGROUND OF THE INVENTION

The present invention relates generally to folding wing structures for airborne vehicles such as missiles and the like.

Many rockets and missiles utilize some form of wing or stabilizer structure for stabilizing and guiding the airframe during flight. Missiles are frequently stored and launched from tubular launchers, and may be deployed from aircraft, ships or land vehicles, where storage space is limited. Under such circumstances it is necessary to minimize the space required for storage of the missile prior to launch, and fixed wings substantially increase the storage space requirements.

In view of this, various folding or collapsible wing structures have been proposed in the past for missiles and rockets, which are initially collapsed into a storage position in which they are substantially flush with the missile body, and which can be erected automatically during flight of the missile to swing out from the missile body. In U.S. Pat. No. 4,351,499 of Maudal et al., which is assigned to the same assignee as the present application, for example, a retractable, self erecting wing for a missile is described, which comprises a double walled flexible fabric body held in an extended position by spring loaded struts. The wing is folded into a slot in the outer wall of the missile. A simi)ar structure is shown in U.S. Pat. No. 4,586,680 of DiTommaso et al., also assigned to the same assignee as this application. In this case the strut assembly supporting the double walled wing comprises a leading and a trailing strut each comprising a telescoping upper and lower tubular member each pivoted at their lower ends to a support structure and pivoted together at their upper ends to form a triangular structure when fully erect. Compression springs within the struts force them towards their fully extended position. Locking tabs are provided to resist collapse of the tubular members when erect.

It has been found that these previous structures have the capability to deploy and provide aerodynamic lifting surfaces at air speeds up to around Mach 0.2 at sea level. The double walled fabric wing encloses an air pocket which acts as a damper to resist wing flutter. However, at speeds above Mach 0.2, the ability of the wing to erect is limited because of inadequate erecting force and also because of severe fabric flutter during the erection process. If the wing is successfully erected, the locking mechanism may provide inadequate structural strength at very high speeds, and the fabric flutter at such speeds may over stress, heat and destroy the fabric of the wing, particularly at angles of attack at and around zero. Thus the wing is liable to disintegrate at speeds above Mach 0.2.

SUMMARY OF THE INVENTION

It is an object of the present invention to provide an improved folding wing structure of the double walled type which can survive at higher speeds.

According to the present invention a folding erectable wing structure for a missile or the like is provided, which comprises a wing supporting strut assembly including a leading strut and a trailing strut pivoted together at adjacent ends and pivotally mounted at their opposite ends either directly to spaced leading and trailing locations on the missile body or to a mounting assembly for mounting on the missile body, the struts being moveable between a collapsed position in which they are substantially colinear, and an expanded, erect position in which they project outwardly from the missile body forming a triangular planform. A biassing assembly urges the struts into a fully extended, erect position. A double walled wing member of flexible fabric material encloses the strut assembly and conforms substantially to the configuration of the struts when fully extended. A series of spaced, parallel reinforcing ribs or battens extend chordwise across each wall of the wing member between the struts when fully erect, to reinforce the fabric and inhibit fabric flutter both during erection and when fully erect.

The battens stiffen the fabric chordwise but still allow the fabric to fold spanwise for stowage prior to erection. Preferably, the strut assembly defines a generally triangular shaped wing when fully erect, and a series of at least three battens extend across each panel or wall of the wing between the struts. The battens are suitably mounted in pockets provided in the wing material.

This arrangement reduces erection loads by reducing or eliminating flutter, and also lowers the stress, wear and heating of the fabric at high speeds, reducing the risk of disintegration of the wing material.

In the preferred embodiment of the invention, the struts each comprise telescoping inner and outer members, and the biassing assembly includes erection springs contained within the struts for biassing them into a fully extended position. The erection springs in the preferred embodiment of the invention comprise coaxial parallel springs for increased erection force. The biassing assembly also includes an additional spring assembly for urging the struts towards their erect position, and in the preferred embodiment of the invention the additional biassing is provided by at least two leaf springs.

The foldable wing structure may be mounted directly in a recess provided in the body of the missile itself, or alternatively a wing housing may be provided for containing the wing structure when collapsed, with a slot for allowing the wing structure to project out of the housing when erect. This housing may be mounted internally or externally on a missile casing. A series of identical wing structures wi)l be circumferentially arranged around a missile casing in practice.

The upper tubular member of each strut preferably also includes a locking tang or finger at its inner end for resisting collapse of the strut, the tang being urged outwardly when the strut is fully extended to engage the face of the lower tubular member to prevent collapse of the members. A protective cover or support is provided surrounding the locking tang when extended, to resist buckling of the tang. This also adds to the strength of the assembly when fully erect.

The combination of increased erection force, reinforcing battens, and locking tang support, has been found to provide a wing which will erect and survive at least up to the highest speed wind tunnel tested of Mach 0.69 at sea level. The wing was flight tested at Mach 0.56.

BRIEF DESCRIPTION OF THE DRAWINGS

The present invention will be better understood from the following detailed description of a preferred embodiment of the invention, taken in conjunction with the accompanying drawings, in which like reference numerals refer to like parts and in which.

DESCRIPTION OF THE PREFERRED EMBODIMENT

Figure 1:
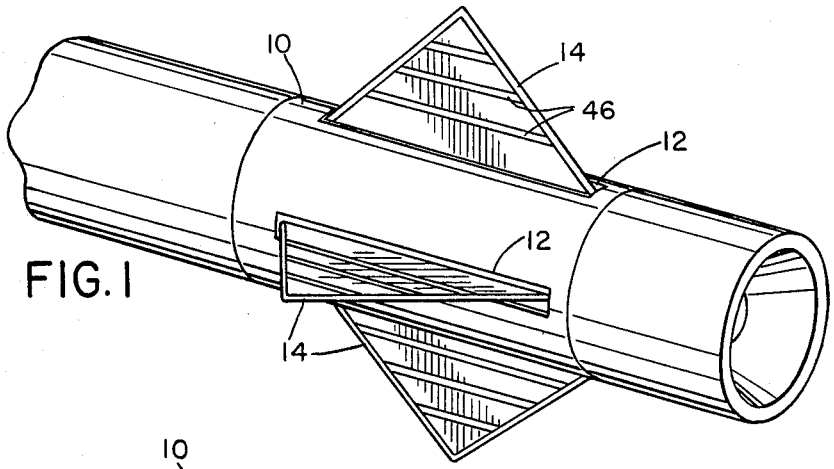
FIG. 1 is a perspective view of a portion of a typical missile incorporating foldable, self-erecting wing structures according to a preferred embodiment of the present invention.

FIG. 1 of the drawings shows part of a missile or other airframe having a generally cylindrical body 10 with a plurality of circumferentially arranged longitudinal slots 12. A self-erecting wing 14 according to a preferred embodiment of the present invention extends radially outwardly from each of the slots. A cruciform arrangement of four wings is shown in FIG. 1, but any desired number of wings may be installed.

Figure 2:
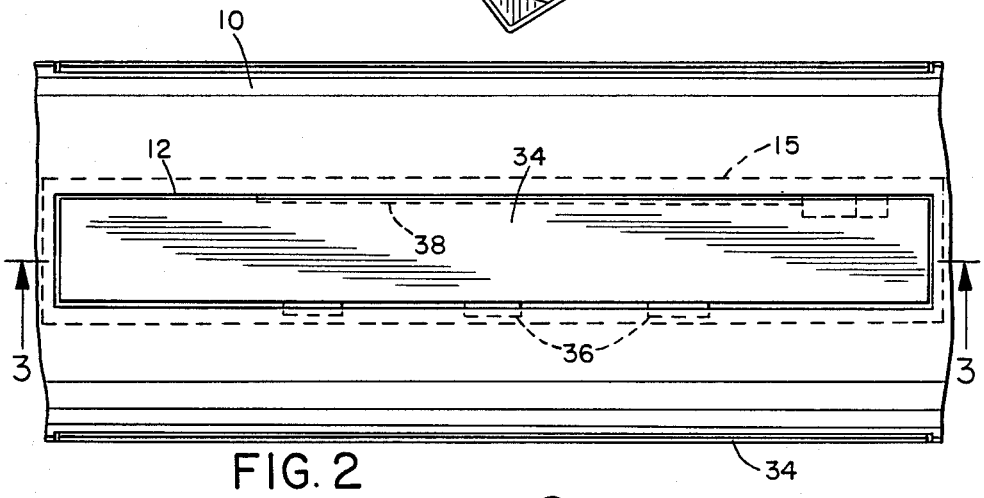
FIG. 2 is a side elevation view of the missile with the wings retracted and enclosed within the missile.
Figure 3:
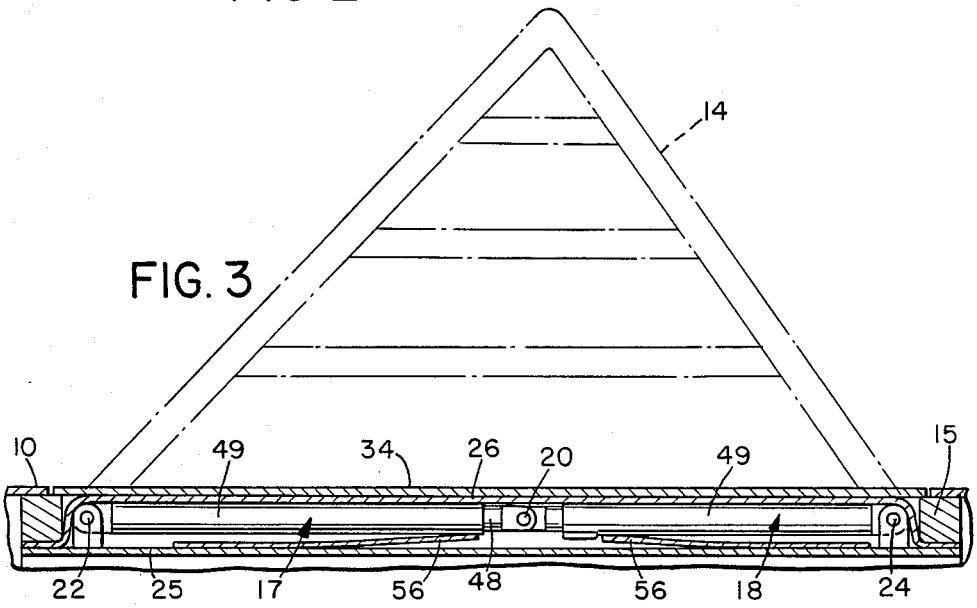
FIG. 3 is a sectional view taken on the line 3—3 of FIG. 2.
Figure 4:
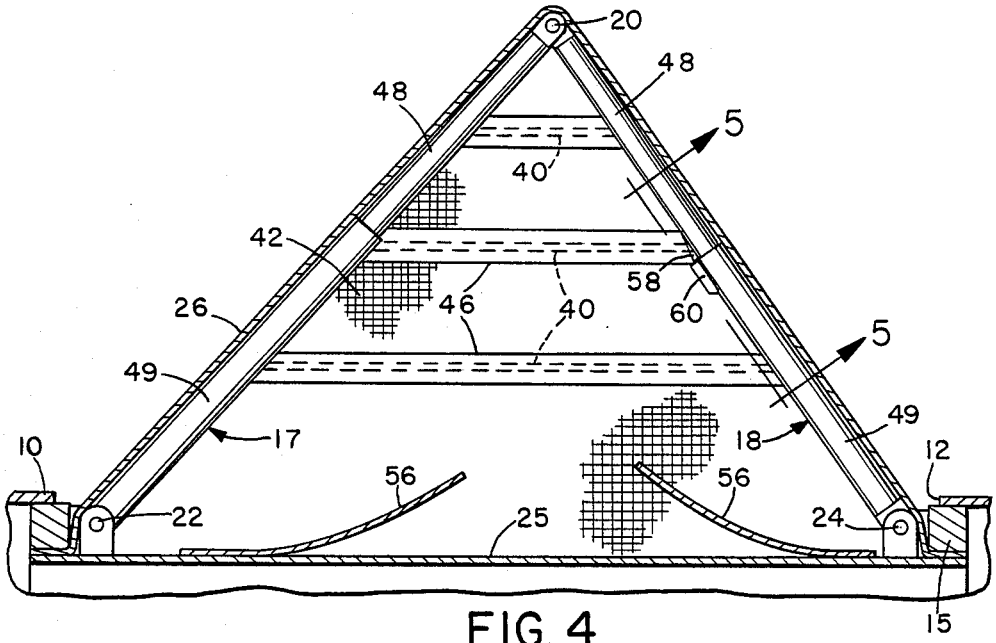
FIG. 4 is a sectional view similar to FIG. 3, with the wing erected.

The wing structure may be directly mounted to suitable support surfaces of the missile itself within a recess provided in the missile body, but in the preferred embodiment of the invention the structure is in the form of a self-contained, modular unit which can be detachably mounted within the rocket body positioned for extension or retraction through the appropriate slot 12. Alternatively, the unit may be designed to be mounted externally on the missile body, with a suitable aerodynamic housing design, where there is insufficient space within the body of the missile to accommodate the wing structure. In the embodiment shown in the drawings, the wing structure is mounted in a channel housing 15, which may be suitably bolted within a recess in the missile body. The selferecting wing structure is shown in more detail in FIGS. 2 to 7. As best shown in FIGS. 3 and 4, the structure basically comprises a supporting strut assembly including a leading strut 17 and a trailing strut 18 which are pivotally secured together at their adjacent outer ends via a hinge pin 20. The inner ends of the struts 17, 18 are pivotally mounted on hinge pins 22, 24, respectively at the leading and trailing ends of a base plate 25 of the housing 15, which serves as the primary attachment structure for the wing struts. The struts 17, 18 are preferably each in the form of upper and lower telescoping tubular members 48 and 49.

The strut assembly is moveable between the collapsed, storage position shown in FIG. 3 in which the struts are substantially colinear and contained within housing 15, and the expanded, erect position shown in dotted outline in FIG. 3 and in FIG. 4 in which they project radially outwardly from the body 10 to define a generally triangular wing configuration. The wing is preferably triangular as shown, although suitable alternative configurations may be used. The strut assembly is enclosed by a double walled cover or pocket 26 of flexible fabric material, such as reinforced plastic, plastic, lightweight nylon, or other similar materials which is cut and sewn to conform precisely to the shape of the supporting strut assembly in its extended position. The base edge of the wing fabric 26 is peripherally secured around the edge of the housing or missile slot by any suitable means, for example by clamping between the base plate 25 and upper wall of the housing as indicated in FIGS. 3 and 4.

In the storage position the struts and wing fabric are folded within the housing as indicated in solid outline in FIG. 3. A detachable cover plate 34 normally covers the retracted wing structure, as indicated in FIGS. 2 and 3. The cover plate acts to retain the wing in its collapsed position until released. The release mechanism for releasing cover plate 34 is preferably of the type described in U.S. Pat. No. 4,586,680 referred to above, including hinges 36 extending along one side of the cover plate and latches 38 extending along the other side, the latches being released automatically at an appropriate time by a suitable explosive charge.

Figure 5:
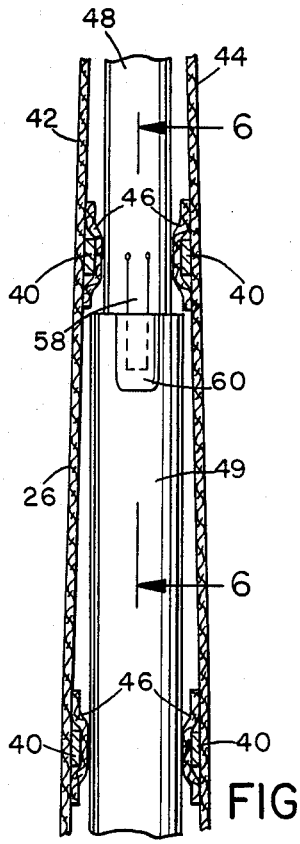
FIG. 5 is an enlarged sectional view taken on the line 5—5 of FIG. 4.

A series of spaced, parallel ribs or battens 40 extend chordwise across each wall 42, 44 of the double walled wing cover between the supporting struts, as shown in FIGS. 1, 3 and 4. The ribs are mounted in suitable pockets 46 provided in the wing, as best shown in FIG. 5. Since the ribs extend chordwise across the wing, they allow the fabric to be folded spanwise for storage in the retracted position shown in FIG. 3.

Figure 6:
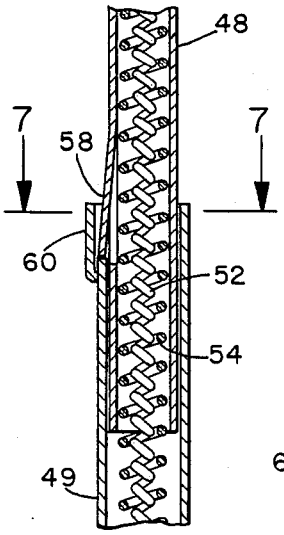
FIG. 6 is a sectional view taken on the line 6—6 of FIG. 5.

The wing structure is biassed into the expanded, erect position shown in FIGS. 1 and 4 by a suitable biassing mechanism, so that when the cover plate is released the wing will erect itself automatically. A compression spring assembly is contained within each of the struts and extends along the length of the struts for biassing the upper and lower members 48 and 49 into their fully extended position. Each spring assembly preferably comprises a pair of co-axial parallel springs 52, 54, as shown in FIG. 6, for providing increased erection force. The springs may be pre-stressed for increased energy storage when compressed. Additionally, a pair of leaf springs 56 are mounted on the base plate of the housing directly beneath the strut assembly for applying a force to the struts beneath the hinge pin 20 when the struts are collapsed into the storage position shown in FIG. 3. These springs 56 provide an initial outward thrust on the assembly when the cover is released, preventing the struts from locking in the collapsed position. In a preferred embodiment of the invention, springs 56 were of 0.06 inch thickness beryllium copper, although alternative materials and thicknesses may be used. The use of two leaf springs has been found to increase the starting erection force to 11 lbs and the use of co-axial, pre-stressed compression springs within the struts has been found to increase the full erection force to 10.8 lbs.

Each strut is provided with an anticollapse lock to resist compression of the strut as a result of wing loading during flight. These locks are preferably in the form of tabs or fingers 58 on the inner tubular member of each strut, as best shown in FIG. 6. The locking tabs are of the type described in U.S. Pat. No. 4,586,680 referred to above, and are formed by cutting a narrow, U-shaped slot in the wall of the inner strut member. The finger is then bent outward with its free end pointing towards the end of the outer strut member, so that when biased outward it engages the end of the outer member as indicated in FIG. 6. Thus, when the strut is extended into its fully erect position, the fingers or tabs will spring out into the position shown in FIG. 6 to resist collapse of the struts.

Figure 7:
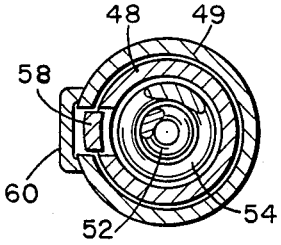
FIG. 7 is an enlarged sectional view taken on line 7—7 of FIG. 6.

One problem with this locking mechanism is that the tabs tend to buckle under high loads encountered at speeds above Mach 0.3, allowing the struts to collapse. Tang supports or covers 60 are therefore provided for protecting the tangs and resisting buckling, as shown in FIGS. 5 to 7. Covers 60 each comprise a curved cover plate formed at the outer end of the outer strut member which surrounds and encloses the end of the tab when the strut is fully extended and prevents it from flipping out or buckling under high loads.

The combination of the reinforcing ribs or battens, the increased biassing force for erecting the strut assembly, as well as the protective covers for the locking tangs, has been found to improve the capability of a self-erecting wing to both erect and survive at relatively high air speeds (Mach 0.69 minimum in a wind tunnel). The reinforcing ribs reduce erection resistance and at the same time stiffen the flexible fabric of the wing so that flutter is reduced both during and after erection of the wing. The co-axial, preloaded compression springs within the struts increase the erection force and act to resist compression of the struts after erection. Finally, the locking tang support covers resist buckling of the locking tangs which might otherwise cause the struts to collapse under high loads. The wing incorporating these improvements has been flight tested to Mach 0.56. Additionally, the wing opening time is reduced considerably. A self-erecting wing without these improvements may take up to 25 milliseconds to erect, whereas the wing described above can be fully deployed in about 9 milliseconds.

Although a preferred embodiment of the invention has been described above by way of example only, it will be understood by those skilled in the field that modifications may be made to the disclosed embodiment without departing from the scope of the invention, which is defined by the appended claims.

We claim:

1. A folding erectable wing structure for an airframe, comprising:

a wing supporting strut assembly including a leading strut and a trailing strut pivotally connected together at adjacent ends, and spaced pivot means for pivotally mounting the opposite ends of the struts at spaced leading and trailing locations relative to an airframe, said struts being moveable between a collapsed, storage position in which they are substantially colinear and an expanded, erect position projecting out of said airframe;

biassing means for urging said struts towards said erect position;

a wing member of flexible fabric material in the form of a double walled pocket conforming in shape substantially to the extended position of said struts nd moveable with said struts, the wing member enclosing said strut assembly; and a series of spaced, parallel reinforcing ribs secured to each wall of said wing member and extending chordwise across the respective wall between the struts in the erect position of said struts.

2. The structure as claimed in claim 1, wherein each wall of the wing member has a series of spaced, parallel pockets extending chordwise across the wall, and a respective rib is mounted in each pocket.

3. The structure as claimed in claim 1, wherein the wing is generally triangular when erect, and a series of three reinforcing ribs of different, increasing lengths are mounted at spaced intervals across each wall of the wing fabric.

4. The structure as claimed in claim 1, wherein each strut comprises an inner and an outer telescoping tubular member moveable between a collapsed position for storage and an extended position when the wing is erect, said biassing means including a compression spring assembly disposed within and extending substantially the length of the inner and outer telescoping members of each strut, each compression spring assembly comprising co-axial parallel inner and outer compression springs.

5. The structure as claimed in claim 1, including locking means for locking the struts in the erect position, and support means for reinforcing the locking means against collapse.

6. The structure as claimed in claim 5, wherein each strut comprises telescoping inner and outer members, said biassing means including means for biassing said members away from one another towards a fully extended position, said locking means comprising an outwardly biassed tab on the inner member for moving outwardly when the members are extended to engage the opposing end of the outer member to resist collapse of the members, said support means comprising cover means for covering said tab to resist outward buckling of the tab.

7. The structure as claimed in claim 6, wherein said cover means of each strut comprises a curved cover plate at the inner end of each outer member opposing the inner member for extending over the end of the respective tab when the members are fully extended to prevent the tab from moving outwardly out of alignment with the opposing end of the outer member.

8. The structure as claimed in claim 1, including an elongate outer housing for mounting the wing structure on a missile body and for containing the wing structure in its collapsed position, the housing having an upper wall with an elongate slot through which the wing projects in its erect position, and a lower wall on which the strut assembly is mounted, said pivot means comprising a leading and trailing pivot mounted at respective opposite ends of said lower wall for pivotally mounting said leading and trailing strut, respectively, said biasing means comprising a pair of leaf springs mounted on said lower wall between said pivots and curved outwardly to engage said struts in the collapsed position of the structure to bias the strut assembly outwardly from the housing.

* * * * *